US007950988B2

(12) United States Patent
Demster et al.

(10) Patent No.: US 7,950,988 B2
(45) Date of Patent: May 31, 2011

(54) VARIABLE VOLUME FLOOR DIFFUSER WITH ATTACHMENT MEANS

(75) Inventors: Stan Demster, Lenexa, KS (US); Andrew Helgeson, Kansas City, KS (US); Michael J. McQueeny, Leawood, KS (US); Jeffery Otte, Overland Park, KS (US); James A. Reese, Albany, MO (US)

(73) Assignee: Airfixture LLC, Kansas City, KS (US)

( * ) Notice: Subject to any disclaimer, the term of this patent is extended or adjusted under 35 U.S.C. 154(b) by 1084 days.

(21) Appl. No.: 11/562,919

(22) Filed: Nov. 22, 2006
(Under 37 CFR 1.47)

(65) Prior Publication Data

US 2008/0119128 A1 May 22, 2008

(51) Int. Cl.
*F24F 9/00* (2006.01)

(52) U.S. Cl. ..... 454/289; 454/284; 454/290; 454/292; 454/322; 454/323; 454/324; 454/330; 454/331

(58) Field of Classification Search ..... 454/284, 454/289, 292, 296, 297, 298, 322, 323, 324, 454/330, 331, 332, 300, 276, 275, 274, 270, 454/271, 333

See application file for complete search history.

(56) References Cited

U.S. PATENT DOCUMENTS

| | | | | |
|---|---|---|---|---|
| 2,891,615 | A * | 6/1959 | Farrell | 160/369 |
| 3,391,629 | A * | 7/1968 | Snell | 454/290 |
| 4,434,710 | A * | 3/1984 | Bolton et al. | 454/277 |
| 5,109,756 | A * | 5/1992 | Barboza et al. | 454/284 |
| 5,472,380 | A * | 12/1995 | Sarazen et al. | 454/290 |
| 6,083,100 | A * | 7/2000 | Hardy et al. | 454/290 |
| 6,478,673 | B1 * | 11/2002 | Haynes | 454/292 |

FOREIGN PATENT DOCUMENTS

JP 05332601 A * 12/1993

* cited by examiner

*Primary Examiner* — Steven B McAllister
*Assistant Examiner* — Brittany Towns
(74) *Attorney, Agent, or Firm* — Shook, Hardy & Bacon L.L.P.

(57) ABSTRACT

A diffuser for positioning in an opening of a passageway having conditioned air, the diffuser including a grate assembly, a pan assembly, and a retention assembly. The grate assembly includes an upper portion and a lower portion. The upper portion contains an aperture, a plurality of slotted sections, and a flange. The lower portion includes downwardly depending sidewalls and a stop. The pan assembly includes a tray with an aperture and a plurality of upwardly depending legs. The retention assembly couples the grate assembly with the pan assembly and contains a first member that is movable from a first position to a second position for selectively engaging the stop.

28 Claims, 6 Drawing Sheets

VARIABLE VOLUME FLOOR DIFFUSER WITH ATTACHMENT MEANS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

This invention relates to an improved floor diffuser and more particularly to a directional floor diffuser that is movable to emit air in specific directions.

Typical floor diffusers in the industry are made from a number of different materials. Some are constructed from plastic while others may be constructed from metal. Conventional diffusers are typically placed in an opening in the floor. The floor diffusers are sized in accordance with the opening in the floor. The floor diffuser is typically held in place by some attachment means. However, the standard attachment means requires the user to have access to the diffuser both above and below the floor. Specifically, the user must have access to the portion of the floor diffuser that is below the floor to secure the attachment means.

The floor diffusers, in a raised floor system, are attached to the openings in the raised floor and are also generally used to direct air away from the opening in the floor and from the plenum that comprises the area above the concrete floor and below the raised floor. Typically, the floor diffusers are "non-directional" or, in other words, the floor diffusers do not emit the air in any specific direction. Specifically, the nondirectional floor diffusers provide air swirling around the diffuser, thereby not allowing any user adjustability of the dissipation of the air throughout the room. Due to the swirling of the air around the floor diffuser, it is recommended that furniture be placed no closer than 24-36 inches of the center of the diffuser. The constraint on the placement of the furniture reduces the amount of usable floor space.

Accordingly, it would be desirable to manufacture a directional floor diffuser that has the ability to emit air in a specific direction. Further it would be desirable to manufacture a floor diffuser that is movable such that the direction of the air emitted can be changed by the user. Still further it would be desirable to manufacture a floor diffuser that is movable without the need for access below the floor. Still further it would be desirable to manufacture a floor diffuser that may selectively control the amount of air emitted therethrough. Thus, while floor diffusers are known, there remains a need for an improved floor diffuser that has the ability to be locked in place, is movable only by access to the portion above the floor, and can emit varying amounts of air in specific directions.

BRIEF SUMMARY

Accordingly, an improved floor diffuser with a retention means is provided that is movable to emit air in specific directions. The floor diffuser includes a grate assembly, a pan assembly, and a retention assembly. In one embodiment, the grate is generally rectangular in cross-section and includes an upper portion and a lower portion. The upper portion is plate-like and contains an outwardly depending flange. The upper portion further contains a series of slotted sections that emit air in specific directions. The lower portion consists generally of interconnected sidewalls that depend downwardly from a lower surface of the upper portion. The downwardly depending sidewalls form a rectangular housing having four corners. The housing is sized to correspond to the dimensions of a hole in the floor.

The pan assembly contains a rectangular tray and a plurality of legs. The legs are located at each corner of the tray and depend upwardly therefrom. The tray is sized to correspond to the dimensions of the rectangular housing of the grate.

The retention assembly includes a retention screw, a retention bar, and a nut. The retention assembly both couples the grate assembly with the pan assembly and locks the floor diffuser in place. To assemble the floor diffuser, the retention screw is placed through a centrally located aperture in the upper portion of the grate assembly. The retention bar is then threaded onto the retention screw. Next, the legs of the tray are aligned with the corners of the housing and the retention screw is aligned and placed within an aperture located in the tray. The nut is then threaded onto the retention screw until the legs abut a lower surface of the grate and the nut abuts the tray.

In an alternate embodiment the floor diffuser could also be round. The floor diffuser could also contain an air adjustment assembly that can selectively control the amount of air emitted therefrom. The air adjustment assembly contains a plate having a plurality of slots oriented the same as the slots of the grate assembly. The plate is coupled to the underside of the grate assembly and is movable by a wheel to vary the amount of air emitted from the floor terminal.

Additional advantages, and novel features of the invention, will be set forth in part in a description which follows and will become apparent to those skilled in the art upon examination of the following, or may be learned by practice of the invention.

BRIEF DESCRIPTION OF THE SEVERAL VIEWS OF THE DRAWINGS

In the accompanying drawings which form a part of the specification and which are to be read in conjunction therewith, and in which like reference numerals are used to indicate like parts in the various views.

DETAILED DESCRIPTION

Figure 1:
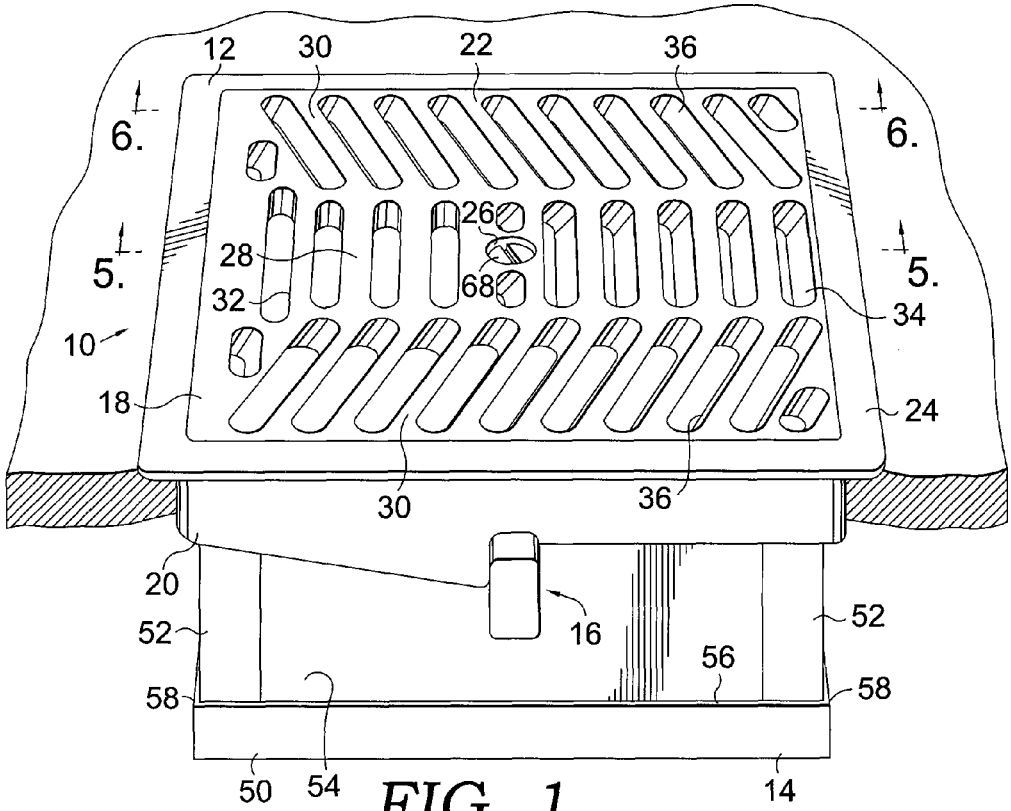
FIG. 1 is a perspective view of a first embodiment of a floor diffuser of the present invention with a retention assembly and a tray, the retention assembly being orientated in the locked position and the diffuser received in a floor.
Figure 2:
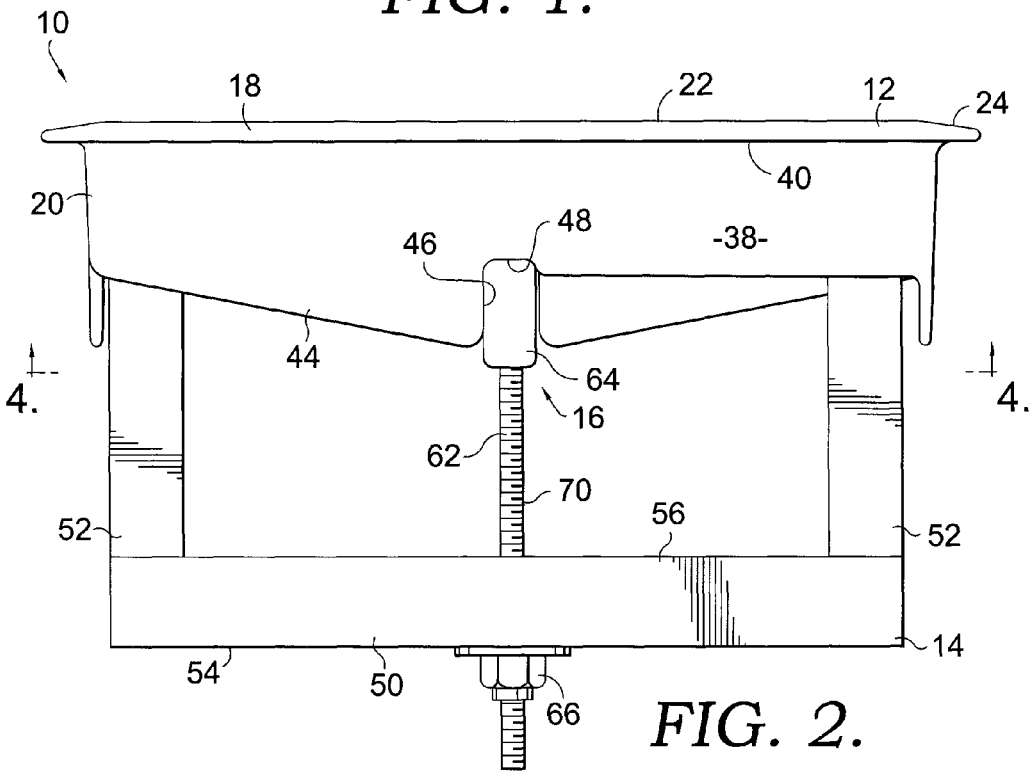
FIG. 2 is a side-elevational view of the floor diffuser of FIG. 1 with the retention assembly in the locked position.

Referring to the drawings in greater detail and initially to FIG. 1, a floor diffuser is shown received in a hole in a floor and is designated generally by the numeral 10. The floor diffuser 10 includes a grate assembly 12, a pan assembly 14, and a retention assembly 16. The grate assembly 12 is generally rectangular and is constructed from die-cast aluminum. It should be understood by one of ordinary skill in the art that any suitable material may be used. As seen in FIGS. 1 and 2, the grate assembly 12 includes an upper portion 18 and a lower portion 20. The upper portion 18 is a plate with an inner portion 22 and an outer portion 24. The inner portion 22 contains a centrally located aperture 26 and a plurality of slotted sections. Specifically, the inner portion 22 contains a middle section 28 and a pair of side sections 30. The middle section 28 contains first and second slotted sections 32, 34. The side sections 30 each contain a plurality of angled slots 36. The configuration of the slotted sections 32, 34, and the angled slots 36 will be discussed further below.

Figure 3:
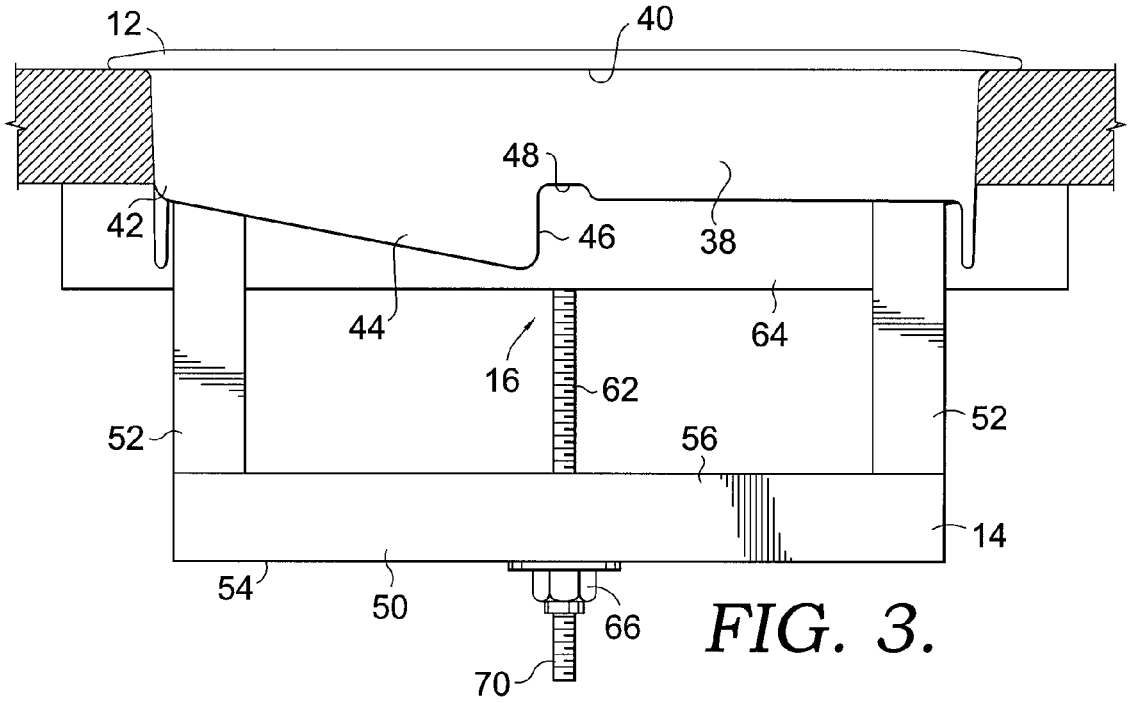
FIG. 3 is a front-elevation view of the floor diffuser of FIG. 1 with the retention assembly in the locked position.

The outer portion 24 is a tapered flange that depends outwardly from the inner portion. As seen in FIGS. 1 and 3, the flange 24 serves to maintain the floor diffuser 10 in contact with the hole in the floor.

Figure 4:
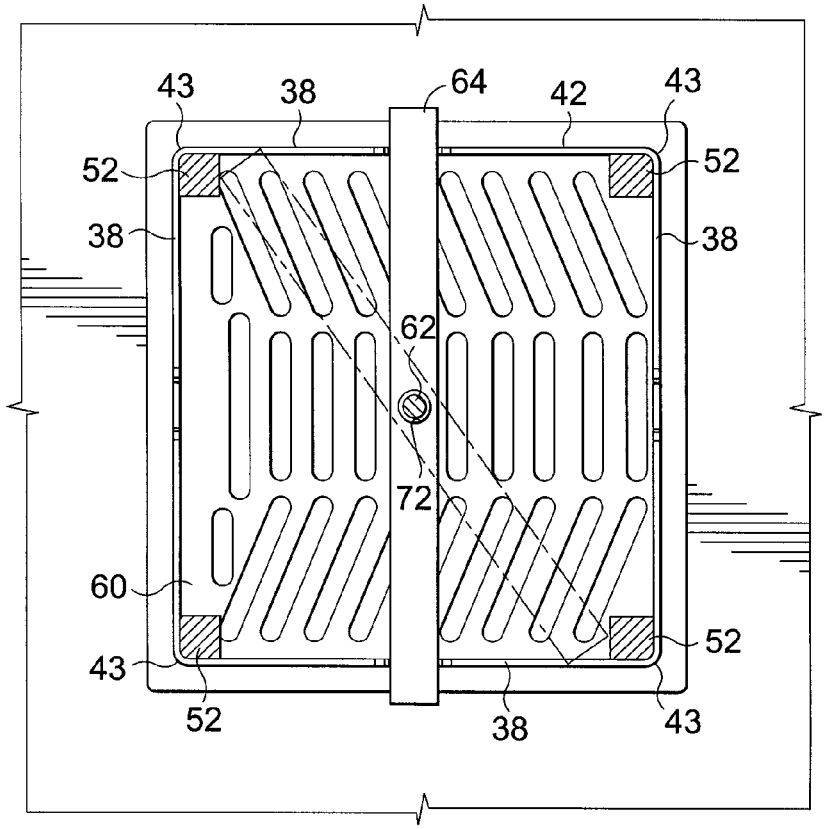
FIG. 4 is a bottom-plan view of the floor diffuser of FIG. 1 with the pan removed, the retention assembly in the locked position, and showing partial lines of the retention assembly in an unlocked position.

Referring now to FIG. 2, the lower portion 20 consists generally of interconnected sidewalls 38 that depend downwardly from a lower surface 40 of the upper portion 18. As seen in FIG. 4, the downwardly depending sidewalls 38 form a rectangular housing 42 containing four corners 43. The housing 42 is sized and configured to accommodate the hole in the floor and is received therein. Referring now to FIGS. 2 and 3, each of the sidewalls 38 is shaped as shown and contains a downwardly projecting protrusion 44, a stop 46, and a notch 48, the importance of which will be described in further detail below. Further, as specifically seen in FIG. 3, the sidewall depth from the lower surface 40 to the notch 48 corresponds to the thickness of the floor.

Referring now to FIGS. 1 and 3, the pan assembly 14 will be discussed. The pan assembly 14 contains a tray 50 and a plurality of legs 52. The tray 50 is generally rectangular and includes a base 54 and a peripheral wall 56. Specifically the tray 50 is sized to correspond to the dimensions of the rectangular housing 42 of the grate 12. The tray 50 further includes a centrally located aperture, not shown, that when the diffuser 10 is assembled is aligned with the aperture 26 contained in the grate 12. The wall 56 extends around a perimeter of the base 54 and depends upwardly therefrom. The legs 52 are located at each corner 58 of the base 54 and depend upwardly from the tray 50. The legs 52 may be integral with the tray 50 or attached thereto by any suitable attachment means. Referring now to FIGS. 1 and 4, it should be understood that an upper portion of the legs 52 abuts a lower surface 60 on the inner portion 22 of the grate 12 when the floor diffuser 10 is assembled.

Referring now to FIGS. 1-3, the retention assembly 16 will be discussed. The retention assembly 16 includes a retention screw 62, a retention bar 64, and a nut 66. The retention screw 62 contains a head 68 and a threaded shaft 70. The threaded shaft 70 is placed within the aperture 26 contained in the upper portion 18 of the grate 12 and the head 68 holds the screw 62 in place. As seen in FIGS. 2 and 4, the retention bar 64 is rectangular in cross-section and has a threaded aperture 72 at its midpoint. The threaded aperture 72 receives the threaded shaft 70 of the retention screw 62. The nut 66 is a standard item and includes a threaded nylon insert.

Figure 5:
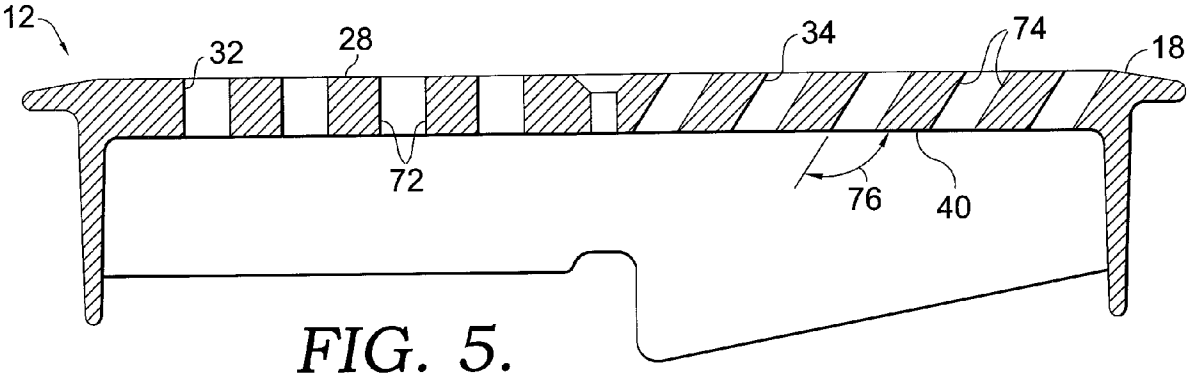
FIG. 5 is a side-elevation, cross-sectional view of the grate assembly of the floor diffuser taken along the line 5-5 of FIG. 1.
Figure 6:
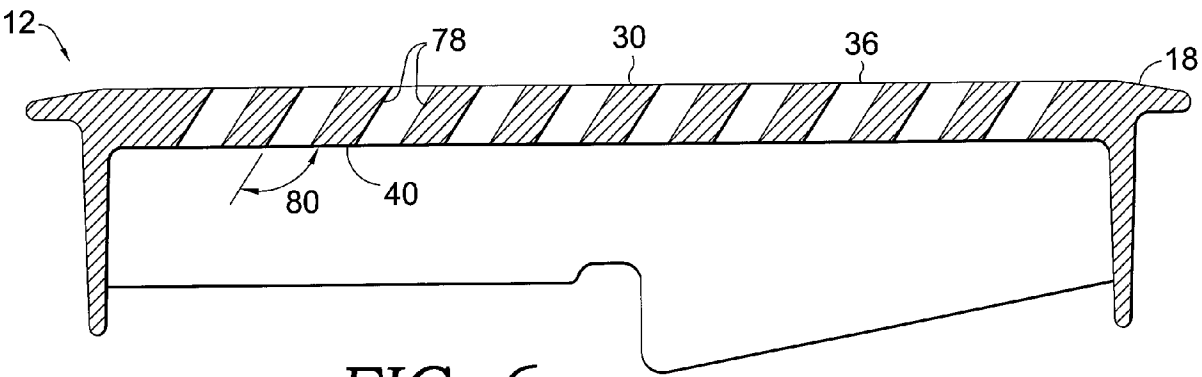
FIG. 6 is a side-elevation, cross-sectional view of the grate assembly of the floor diffuser taken along the line 6-6 of FIG. 1.

Referring now to FIGS. 5 and 6, the orientation of the slotted sections will be discussed. FIG. 5 shows the orientation of the middle section 28 of the grate assembly 12 while FIG. 6 shows the orientation of the side sections 30. Specifically, FIG. 5 shows the orientation of the first and second slotted sections 32, 34 of the middle section 28. The first slotted section 32 contains generally vertical sidewalls 72 that emit air in a generally vertical direction. The second slotted section 34 contains angled sidewalls 74. The angled sidewalls 74 of the second slotted section 34 are designed to emit air in a specific direction. As shown by reference numeral 76, the sidewalls 74 of slotted section 34 are oriented at a non-90° angle with respect to the lower surface 40 of the upper portion 18 of the grate assembly 12.

FIG. 6 shows the orientation of the side sections 30. As stated above, the side sections 30 contain angled slots 36. Specifically the side sections 30 are oriented to emit air away from the grate assembly 12 in specific directions. Further, the orientation of the angled slots 36 of the side sections 30 allow air to be emitted in multiple directions. For the purpose of this discussion, multiple means more than one. The slotted sections 30 contain angled sidewalls 78. Further, while the slotted sections 30 emit air in multiple directions, it should be understood that the orientation of angled sidewalls 78 of both slotted sections 30 are the same. As shown by reference numeral 80, the sidewalls 78 are oriented at a non-90° angle with respect to the lower surface 40 of the upper portion 18 of the grate assembly 12. The orientation of the slotted sections 32, 34, and the angled slots 36 enable the user to control the direction of air flow out of the grate assembly. Further, the configuration of the retention assembly 16 allows the user to quickly remove the diffuser 10 from the floor, rotate the diffuser 10 in the opening in the floor, and selectively choose the direction of air flow from the diffuser 10.

The assembly and operation of the floor diffuser 10 will now be discussed, initially with reference to FIG. 2. The diffuser 10 is assembled before it is placed in the hole in the floor. First, the retention screw 62 is placed though the aperture 26 in the upper portion 18 of the grate. Next, the retention bar 64 is threaded onto the threaded shaft 70 of the retention screw 62 by turning the head 68 of the retention screw in a clockwise manner. The retention bar 64 should be threaded onto the screw 62 a sufficient amount such that the pan 14 may be installed. Specifically, the retention bar 64 must be threaded onto the retention screw 62 such that once installation is complete and the retention screw 62 is turned in a clockwise manner, the retention bar 64 will rotate and contact the stop 46 on the downwardly depending protrusion 44. To install the pan assembly 14, the retention screw 62 is aligned with the centrally located aperture, not shown, in the base 54. The legs 52 of the pan 14 are then placed in an abutting relationship with the corners 43 on the lower surface 60 of the grate assembly 12. Next, the retention screw 62 is placed through the centrally located aperture, not shown, in the base 54. The nut 66 is then threaded onto the retention screw 62 until the legs 52 contact the lower surface 60 of the grate 12 and the nut 66 abuts the base 54 of the pan 50. It should be noted that once the threaded portion 70 of the screw 62 reaches the nylon insert of the nut 66, a wrench and a screwdriver will be needed to further advance the screw 62 into the nut 66. The floor diffuser 10 is now fully assembled.

Now that the floor diffuser 10 is fully assembled, the operation of the floor diffuser 10 will be discussed. In order to place the diffuser 10 in the floor the retention bar 64 must be in the unlocked position, where the retention bar 64 is oriented generally diagonally, as shown by the hidden lines in FIG. 4. The diffuser 10 is then placed in the floor. To place the retention bar 64 in the locked position, shown in FIGS. 2 and 3, the user simply turns the retention screw 62 in a clockwise direction. By turning the retention screw 62, the retention bar 64 is raised on the threaded shaft 70. As the retention bar 64 raises on the threaded shaft, it comes in contact with stop 46 on the downwardly projecting protrusion 44. Once the retention bar 64 contacts the stop 46, further rotation of the screw 62 causes the retention bar 64 to move upwardly into the notch 48 such that it is locked in place, as shown in FIG. 2. At this point, the floor diffuser 10 is unable to be lifted out of the floor.

To remove the floor diffuser 10 from the floor, the user turns the retention screw 62 in a counterclockwise direction. By turning the retention screw 62, the retention bar 64 is lowered on the threaded shaft 70 and is displaced from the notch 48. Once displaced from the notch 48, the retention bar 64 rotates back to the diagonal position, as shown by the hidden lines in FIG. 4. At this point, the floor diffuser 10 may be removed from the floor. Thus, the ability of the user to remove the floor diffuser 10 by simply turning a single screw coupled with the directional orientation of the slotted sections 32, 34, and 36, allows the user to selectively direct the air emitted from the diffuser 10.

Figure 7:
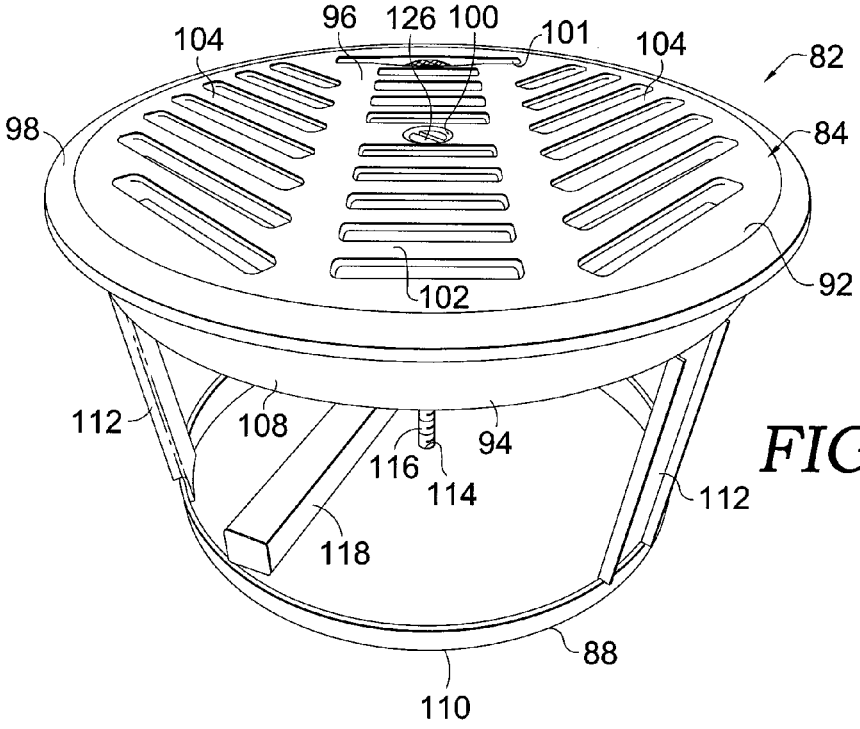
FIG. 7 is a perspective view of a second embodiment of a floor diffuser with an air adjustment assembly, a retention assembly, and a tray.
Figure 8:
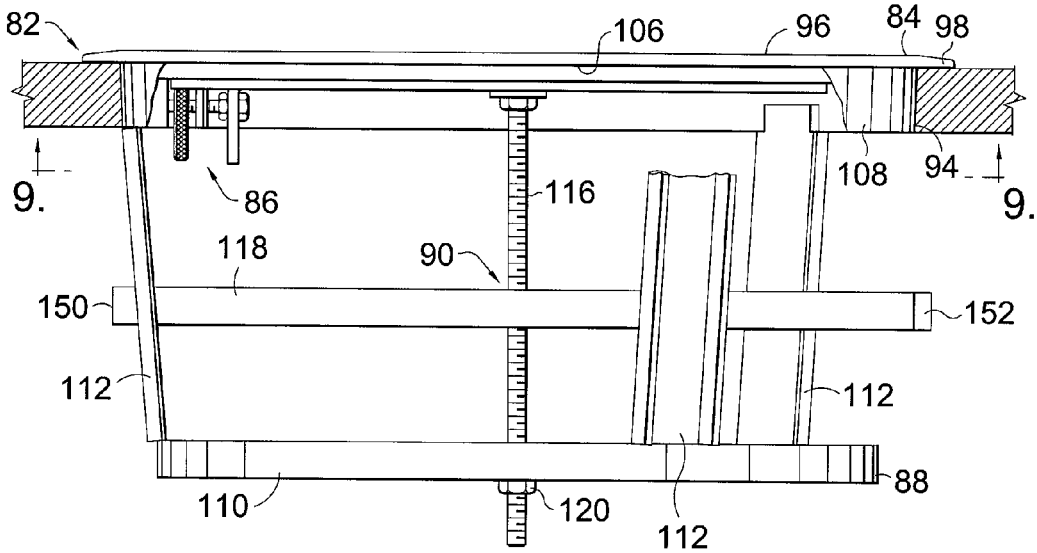
FIG. 8 is a side-elevational view of the floor diffuser of FIG. 7 with parts broken away to show details.

Referring now to FIGS. 7 and 8 a second embodiment of a floor diffuser is shown and is designated generally by the numeral 82. The floor diffuser 82 is similar to the floor diffuser 10 discussed above with the exception that it is circular and contains an air adjustment assembly. The floor diffuser 82 includes a grate assembly 84, an air adjustment assembly 86, a pan assembly 88, and a retention assembly 90. The grate assembly 84 includes an upper portion 92 and a lower portion 94. The upper portion 92 is a plate with an inner portion 96 and an outer portion 98. The inner portion 96 contains a centrally located aperture 100, a plurality of slotted sections, and an elongate slot 101. Specifically, the inner portion 96 contains a middle section 102 and a pair of side sections 104. As seen in FIGS. 5, 6, 11, and 12 the orientation of the slots and their sidewalls in the middle and side sections 28, 30 discussed above is the same as the orientation of the slots and their sidewalls in the middle and side sections 102, 104. As seen in FIGS. 7 and 8, the outer portion 98 is a tapered flange that depends outwardly from the inner portion 96 and serves to maintain the floor diffuser 82 in contact with the hole in the floor. The lower portion 94 is a sidewall that depends downwardly from a lower surface 106 of the upper portion 92 to form a circular housing 108. The housing 108 is sized and configured to accommodate the hole in the floor and is received therein.

The pan assembly 88 of floor diffuser 82 is essentially the same as the pan assembly 14 described above with the exception that it is circular. The pan assembly 88 contains a tray 110 and a plurality of upwardly depending legs 112. The tray 110 has an outer circumference that is generally smaller than the outer circumference of the circular housing 108 of the grate assembly 84. The tray 110 further includes a centrally located aperture 114 that when assembled aligns with the aperture 100 contained in the grate 84.

The retention assembly 90 includes a retention screw 116, a retention bar 118, and a nut 120. The retention assembly 90 is essentially the same as the retention assembly 16 described above, except there is no need for the stop 46 and notch 48. In this embodiment, the retention bar 118 is rotated until it abuts one of the legs 112. Further tightening of the retention screw 116 moves the retention bar up the side of the leg 112 until the retention bar 118 comes into contact with the bottom of the floor. The retention bar 118 is received on the retention screw 116 as described above. The retention screw 116 is placed within the aperture 100 contained in the upper portion 92 of the grate assembly 84 and within an aperture 122 in the pan assembly 88 to assemble the floor diffuser 82.

Figure 9:
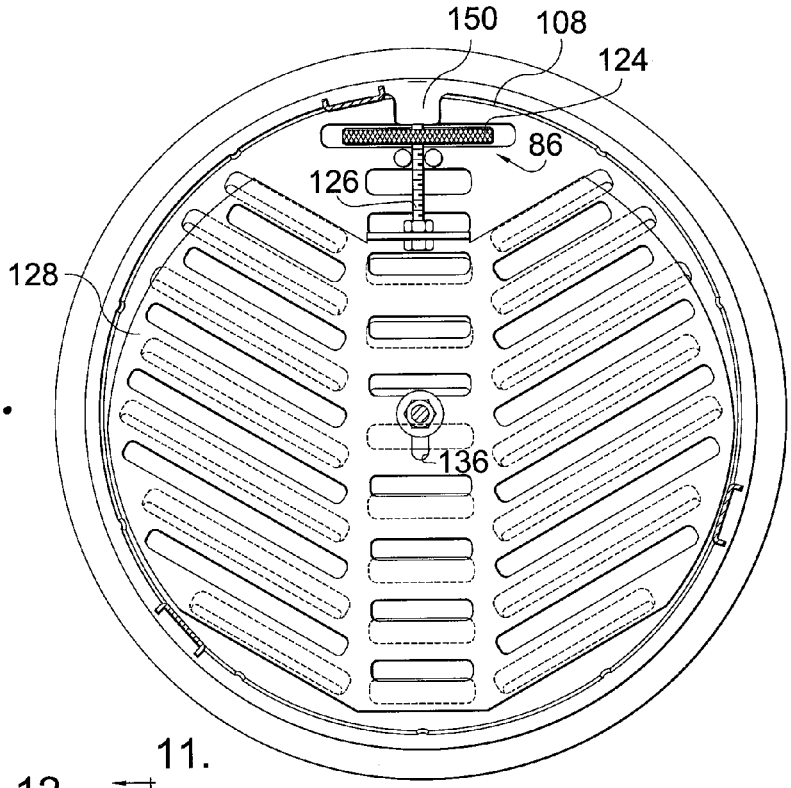
FIG. 9 is a bottom-plan view of the floor diffuser of FIG. 8 taken along the line 9-9, showing the air adjustment assembly in the closed position.
Figure 10:
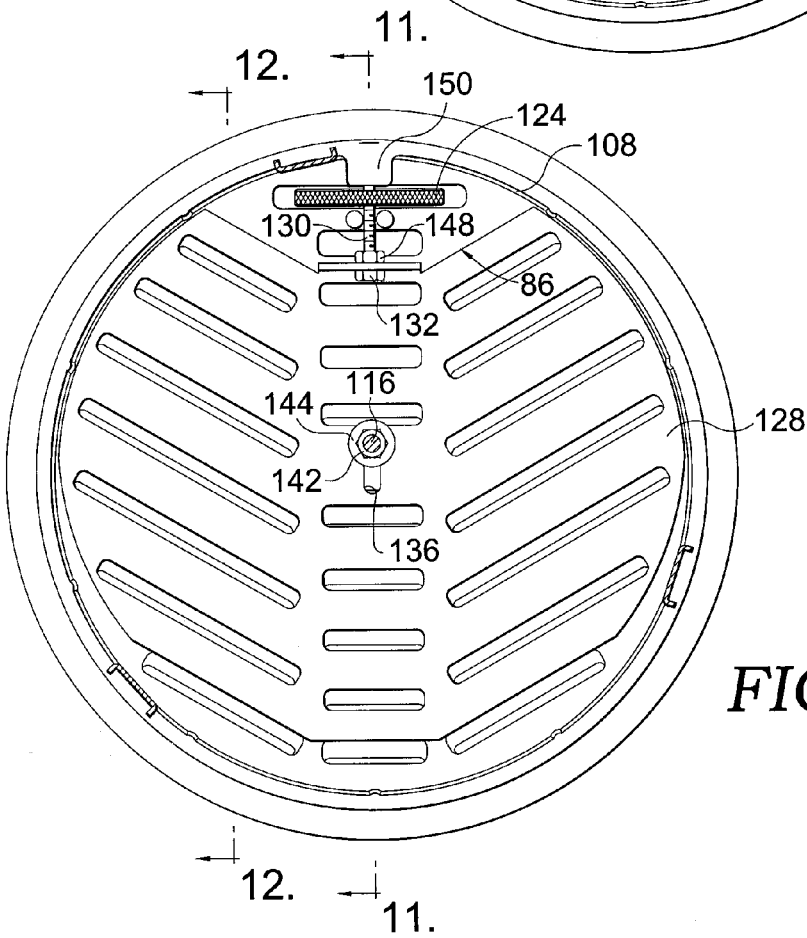
FIG. 10 is a bottom-plan view of the floor diffuser of FIG. 9, but with the air adjustment assembly in the open position.
Figure 11:
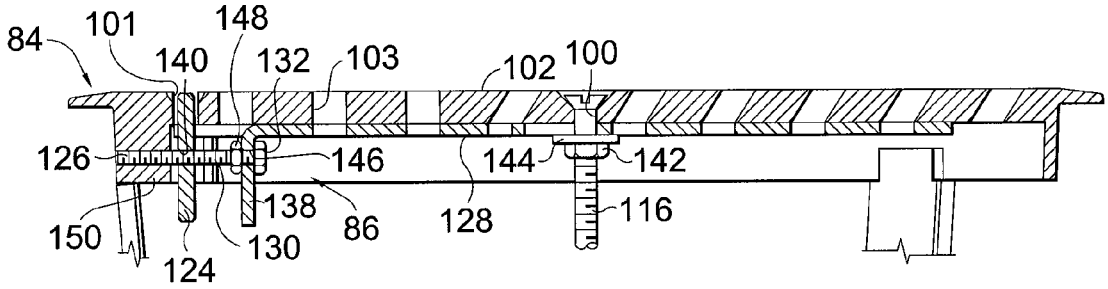
FIG. 11 is a side elevation, cross-sectional view of the floor diffuser of FIG. 10 taken along the line 11-11.
Figure 12:
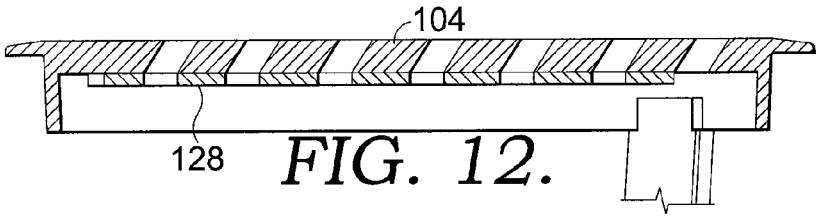
FIG. 12 is a side elevation, cross-sectional view of the floor diffuser of FIG. 10 taken along the line 12-12.
Figure 13:
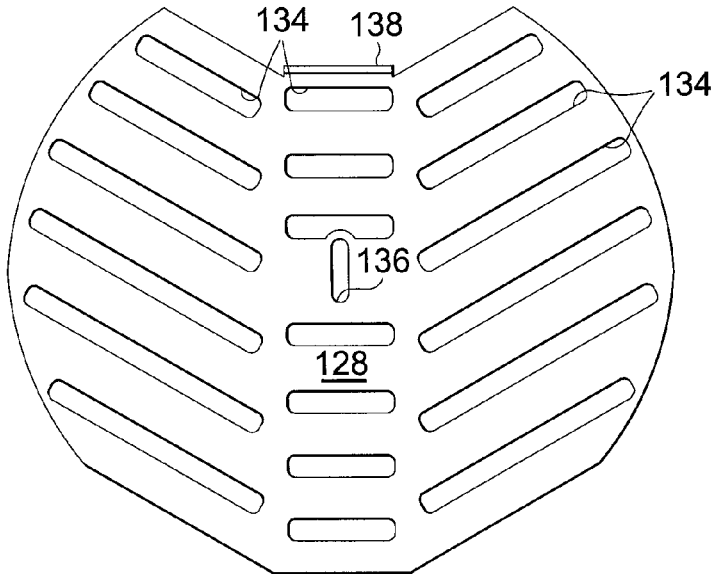
FIG. 13 is a bottom-plan view of the plate of the air adjustment assembly.

Referring now to FIGS. 9-13, the air adjustment assembly 86 will be discussed. FIG. 9 shows the air adjustment assembly 86 in the closed position while FIGS. 10, 11, and 12 show the air adjustment assembly 86 in the open position. The air adjustment assembly 86 includes a wheel 124, a retaining bolt 126, and a plate 128. The plate 128 is attached to the grate assembly 84 by the retaining bolt 126 and the retention screw 116. The wheel 124 along with the retaining bolt 126 are used to move the plate 128, and in turn the air adjustment assembly 86 from the closed position of FIG. 9 to the open position of FIGS. 10, 11, and 12. The retaining bolt 126 contains a threaded shaft 130 and a head 132. The wheel 124 contains a centrally located threaded aperture 140 that receives the threaded shaft 130 of the retaining bolt 126. A portion of the wheel is aligned within the elongate slot 101 in the grate assembly 84, as will be further discussed below. The plate 128 includes a plurality of slots 134, a centrally located elongate aperture 136, and a tab 138. The plurality of slots 134 match the pattern of slots of the slotted middle section 102 and side sections 104. The centrally located elongate aperture 136 is aligned with the aperture 100 contained in the upper portion 92 of the grate assembly 84 and the retention screw 116 passes therethrough. A nut 142 and a washer 144 are received on the retention screw 116 and abut the plate 128. The tab 138 depends downwardly from the plate 128 and contains an aperture 146 therein. The retaining bolt 126 is placed within the aperture 146 and a nut 148 is placed opposite the head. The threaded shaft 130 is received in a threaded block 150 located on the underside of the grate assembly 84 proximate the housing 108.

As such, once assembled, the wheel 124 may be used to move the air adjustment assembly 86 from the closed position in FIG. 9 to the open position in FIGS. 10 and 11. Specifically, to move the air adjustment assembly 86 from the closed position in FIG. 9 to the open position in FIGS. 10 and 11, the user may rotate the wheel 124 in the clockwise direction. Further, to move the air adjustment assembly 86 from the open position in FIGS. 10 and 11 to the closed position in FIG. 9, the user may rotate the wheel 124 in the counterclockwise direction. Rotation of the wheel 124 causes the bolt 126 received therein to move, which in turn causes the plate 128 to move with respect to the grate assembly 84. As such the amount of air emitted from the diffuser 82 can be controlled.

Referring again to FIGS. 7 and 8 the installation of the floor diffuser 82 will now be discussed. To install the floor diffuser in the floor, the retention bar 118 must be lowered to a point near the tray 110. The retention bar 118 may be lowered by turning the retaining bolt 126 counterclockwise. Once the retention bar 118 has been lowered, the floor diffuser may then be placed within the hole in the floor by tilting the floor diffuser such that a first end 150 of the retention bar 118 may be placed under the floor. Once the first end 150 is placed under the floor, the floor diffuser 82 may then be manipulated within the hole to allow a second end 152 of the retention bar 118 to fit therebelow. As such, both ends 150, 152 of the retention bar 118 are now located below the floor. The user may then turn the floor diffuser 82 to selectively direct air in the appropriate direction. Once the direction has been fixed, the user may then turn the retaining bolt 126 in a clockwise direction which, in turn, causes the retention bar 118 to move vertically up the retention screw 116 and, thus, lock the floor diffuser 82 in place.

The present invention has been described in relation to particular embodiments, which are intended in all respects to be illustrative rather than restrictive. Alternative embodiments will become apparent to those skilled in the art to which the present invention pertains without departing from its scope. For example, the plate 128 of the air adjustment assembly 86 of the second embodiment may be modified such that the air adjustment assembly is used with the square floor diffuser 10 of the first embodiment. It will be seen from the foregoing that this invention is one well adapted to attain the ends and objects set forth above and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A diffuser for positioning in an opening of a passageway having conditioned air, the diffuser including:

a grate assembly having an upper portion and a lower portion that depends downwardly from a lower surface of the upper portion, the upper portion having an aperture and a plurality of slotted sections;

a pan assembly having a tray with an aperture formed therein and a plurality of upwardly depending legs, wherein each of the plurality of upwardly depending legs includes an upper portion that substantially abuts the lower surface of the upper portion of the grate assembly; and a retention assembly for coupling the grate assembly with the pan assembly and for installing the diffuser within the opening, the retention assembly comprising:

a retention screw that is placed through the aperture in the upper portion of the grate assembly and the aperture in the tray of the pan assembly; and a member having a length greater than a diameter of the opening coupled to the retention screw in a location between the upper portion of the grate assembly and the tray, wherein the member resides in an unlocked position near the tray of the pan assembly when the diffuser is placed within the opening during installation, wherein turning the retention screw causes the member to rotate and contact at least one of the plurality of legs and assume a locked position, and wherein continued turning of the retention screw when the member is in the locked position causes the member to move upwardly along the retention screw toward the grate assembly.

2. The diffuser of claim 1, wherein the upward movement of the member is arrested upon one or more portions of the member contacting a bottom of a floor through which the opening is formed.

3. The diffuser of claim 1, wherein the member is configured as a retention bar that includes a threaded aperture for receiving the retention screw.

4. The diffuser of claim 1, wherein the lower portion of the grate assembly includes interconnected sidewalls that are sized to accommodate the opening.

5. The diffuser of claim 1, wherein the plurality of slotted sections includes a pair of side sections and a central section.

6. The diffuser of claim 5, wherein the central section and side sections are configured to emit the conditioned air generally in a common direction.

7. The diffuser of claim 6, wherein the central section includes a plurality of elongate slots having a longitudinal axis oriented in a uniform direction.

8. The diffuser of claim 7, wherein each of the elongate slots includes a pair of sidewalls in substantially parallel-spaced relation to each other.

9. The diffuser of claim 8, wherein at least one of the pair of the slot sidewalls is configured in a generally vertical alignment.

10. The diffuser of claim 9, wherein at least one of the pair of the slot sidewalls is oriented at a non-perpendicular angle.

11. The diffuser of claim 5, wherein the side sections include a plurality of elongate slots having a longitudinal axis.

12. The diffuser of claim 11, wherein the longitudinal axis of the slots of the side sections are angled relative to an axis of the slots of the central section.

13. The diffuser of claim 12, wherein the slots of the side sections include a pair of angled sidewalls.

14. A diffuser for positioning in an opening of a passageway having conditioned air, the diffuser including:

a grate having a plurality of slotted sections for directing airflow and a centrally located aperture;

a pan assembly having a tray with a centrally located aperture and a plurality of upwardly depending legs that substantially abut the grate; and a retention assembly for coupling the grate with the pan assembly and for installing the diffuser within the opening, the retention assembly comprising:

a retention screw that is placed through both the centrally located aperture in the grate assembly and the centrally located aperture in the tray of the pan assembly; and a retention bar having a length that is greater than a diameter of the opening and an aperture therethrough that substantially bisects the retention bar, wherein the aperture is coupled to the retention screw such that the retention bar resides in a location between the grate assembly and the tray, wherein turning the retention screw causes the retention bar to rotate and abut at least one of the plurality of legs, wherein continued turning of the retention screw causes the retention bar to move upwardly along the abutted at least one of the plurality of legs, and wherein the upward movement of the retention bar is arrested upon the retention bar contacting a bottom of a floor through which the opening is formed.

15. The diffuser of claim 14, wherein the retention screw is externally threaded, and wherein the aperture in the retention bar is internally threaded and coupled in threaded engagement to the external threads of the retention screw.

16. The diffuser of claim 14, wherein the retention bar is movable between a first position disengaged from the plurality of legs and a second position engaged to at least one of the plurality of legs.

17. The diffuser of claim 16, wherein the rotation of the retention bar represents horizontal movement between the first and second positions.

18. The diffuser of claim 17, wherein movement of the retention bar from the first position to the second position serves to lock the diffuser within the opening.

19. The diffuser of claim 18, wherein movement of the retention bar from the second position to the first position serves to unlock the diffuser from the bottom of the floor such that the diffuser may be removed from the opening.

20. The diffuser of claim 14, wherein the plurality of upwardly depending legs are generally vertical.

21. The diffuser of claim 14, wherein the centrally located aperture in the grate and the centrally located aperture in the tray of the pan assembly are coaxial.

22. A diffuser for positioning in an opening of a passageway having conditioned air, the diffuser including:

a grate assembly having an upper portion and a lower portion, the upper portion having an aperture and a plurality of slotted sections;

a pan assembly having a tray with an aperture formed therein and a plurality of upwardly depending legs, wherein each of the plurality of upwardly depending legs includes an upper portion that substantially abuts the upper portion of the grate assembly;

a retention assembly for coupling the grate assembly with the pan assembly and for installing the diffuser within the opening, the retention assembly comprising:

a retention screw that is placed through the aperture in the upper portion of the grate assembly and the aperture in the tray of the pan assembly; and a member having a length greater than a diameter of the opening coupled to the retention screw in a location between the upper portion of the grate assembly and the tray, wherein the member resides in an unlocked position near the tray of the pan assembly when the diffuser is placed within the opening during installation, wherein turning the retention screw causes the member to rotate and contact at least one of the plurality of legs and assume a locked position, and wherein continued turning of the retention screw when the member is in the locked position causes the member to move upwardly along the retention screw toward the grate assembly; and after "the retention assembly" and before "an air adjustment assembly".

an air adjustment assembly slidably coupled with the grate assembly comprising:

a plate having a plurality of slotted sections, the plate being adapted to move between a first position and a second position, wherein, when the plate is adjusted to the first position, the plate prevents airflow, and wherein, when the plate is adjusted to the second position, the plate permits airflow;

a retaining bolt having a threaded shaft, wherein the retaining bolt is coupled to the plate; and a wheel having an aperture that receives the threaded shaft of the retaining bolt, wherein bi-directional rotation of the wheel laterally adjusts the plate between the first position and the second position.

23. The diffuser of claim 22, wherein an orientation of the plurality of slotted sections within the grate assembly is comparable to an orientation of the plurality of slotted sections of the plate.

24. The diffuser of claim 22, wherein a pattern of the plurality of slotted sections within the grate assembly matches a pattern of the plurality of slotted sections of the plate.

25. The diffuser of claim 22, wherein the air adjustment assembly further comprises a threaded block associated with the lower portion of the grate assembly, wherein the threaded block receives the threaded shaft of the retaining bolt.

26. The diffuser of claim 22, wherein the plate comprises a downwardly extending tab that couples to the retaining bolt.

27. The diffuser of claim 22, wherein the plurality of slotted sections within the grate assembly include an elongate slot, wherein a portion of the wheel is aligned with and extends through the elongate slot allowing a user to rotate the wheel from above the grate assembly.

28. The diffuser of claim 22, wherein the plate comprises a centrally located elongate aperture that aligns with the aperture within the grate assembly and the aperture within the tray of the pan assembly, and wherein the elongate aperture of the plate receives the rod, which couples to a fastener that slidably engages and vertically supports a lower surface of the plate.

* * * * *